US006619313B2

(12) United States Patent
Boughton et al.

(10) Patent No.: US 6,619,313 B2
(45) Date of Patent: Sep. 16, 2003

(54) HOSE REELS

(75) Inventors: Robert Dudley Boughton, Twyford (GB); Nicolina Iaciofano, High Wycombe (GB)

(73) Assignee: Hozelock Limited, Aylesbury (GB)

( * ) Notice: Subject to any disclaimer, the term of this patent is extended or adjusted under 35 U.S.C. 154(b) by 0 days.

(21) Appl. No.: 09/893,249

(22) Filed: Jun. 27, 2001

(65) Prior Publication Data

US 2002/0029803 A1 Mar. 14, 2002

(51) Int. Cl.[7] ..... B65H 75/34

(52) U.S. Cl. ..... 137/355.16; 137/355.2; 242/381; 242/416; 242/550

(58) Field of Search ..... 137/355.16, 355.19, 137/355.2, 355.21; 242/381, 381.5, 550, 565, 410, 416

(56) References Cited

U.S. PATENT DOCUMENTS

| | | | | |
|---|---|---|---|---|
| 1,524,172 A | * | 1/1925 | Dewey | 137/355.16 |
| 1,971,165 A | | 8/1934 | Parker | |
| 2,584,559 A | * | 2/1952 | Dalrymple | 137/355.22 |
| 4,446,884 A | | 5/1984 | Rader | |

FOREIGN PATENT DOCUMENTS

| | | |
|---|---|---|
| CH | 534 632 | 4/1973 |
| DE | 3712500 A1 | 10/1988 |
| EP | 0 934 899 A2 | 8/1999 |
| GB | 481030 | 3/1938 |
| GB | 670717 | 4/1952 |
| JP | 1247375 | 10/1989 |
| JP | 1252468 | 1/1990 |

* cited by examiner

*Primary Examiner*—Kevin Lee
(74) *Attorney, Agent, or Firm*—Barnes & Thornburg

(57) ABSTRACT

A hose reel has a drum (4) having a damper (15) for damping rotational movement of the drum in at least one direction, corresponding to the unwinding of a hose pipe from the drum. The damper prevents unwanted unwinding of hose pipe from the drum due to inertia in the latter.

8 Claims, 5 Drawing Sheets

HOSE REELS

This invention relates to hose reels for holding hose pipes for watering.

When a hose pipe is unwound from a known hose reel the momentum of the unwinding motion tends to cause more hose pipe to be unwound than is required, resulting in the outermost turn or so of the hose pipe being no longer neatly coiled around the drum of the hose reel. This partial uncoiling of the last turn or so of the portion of hose pipe remaining on the reel (after another portion of the hose pipe has been pulled out) is known as overrun and the object of the invention is to provide a hose reel not suffering from overrun.

According to the invention a hose reel has a drum rotatable in a first direction to cause a hose pipe to be wound around the drum and in a second direction to cause or allow the hose pipe to be unwound from the drum, wherein the drum has a damper operative to damp rotational movement of the drum in the second direction in order to prevent unwanted unwinding of the hose pipe from the drum.

The hose reel is preferably manually operated without spring assistance, the hose reel being equipped with a handle the rotation of which in the first direction causes the hose pipe to be wound onto the drum, the hose pipe being pulled out from the hose reel (with attendant rotation of the drum in the second direction), for unwinding of the hose pipe from the drum.

The damper preferably takes the form of a rotary dashpot having an outer casing mounted on the drum and an inner rotor which is rotatable with respect to the casing when the drum is rotated in the second direction. Preferably, the damper applies no damping action to the drum when the latter is rotated in the first direction.

The handle may form part of a drive assembly carrying a gear wheel the teeth of which mesh with a pinion which drives the inner rotor of the damper.

In a preferred arrangement, the drive assembly also includes a drive dog which is capable of engagement with a driven dog rotatable with the drum, the dogs being urged apart by a spring when the drum is rotated in the second direction but being urged into engagement, against the bias of the spring, when the handle assembly is rotated to turn the drum in the first direction.

A hose reel according to the invention will now be described, by way of example, with reference to the accompanying drawings in which.

Figure 1:
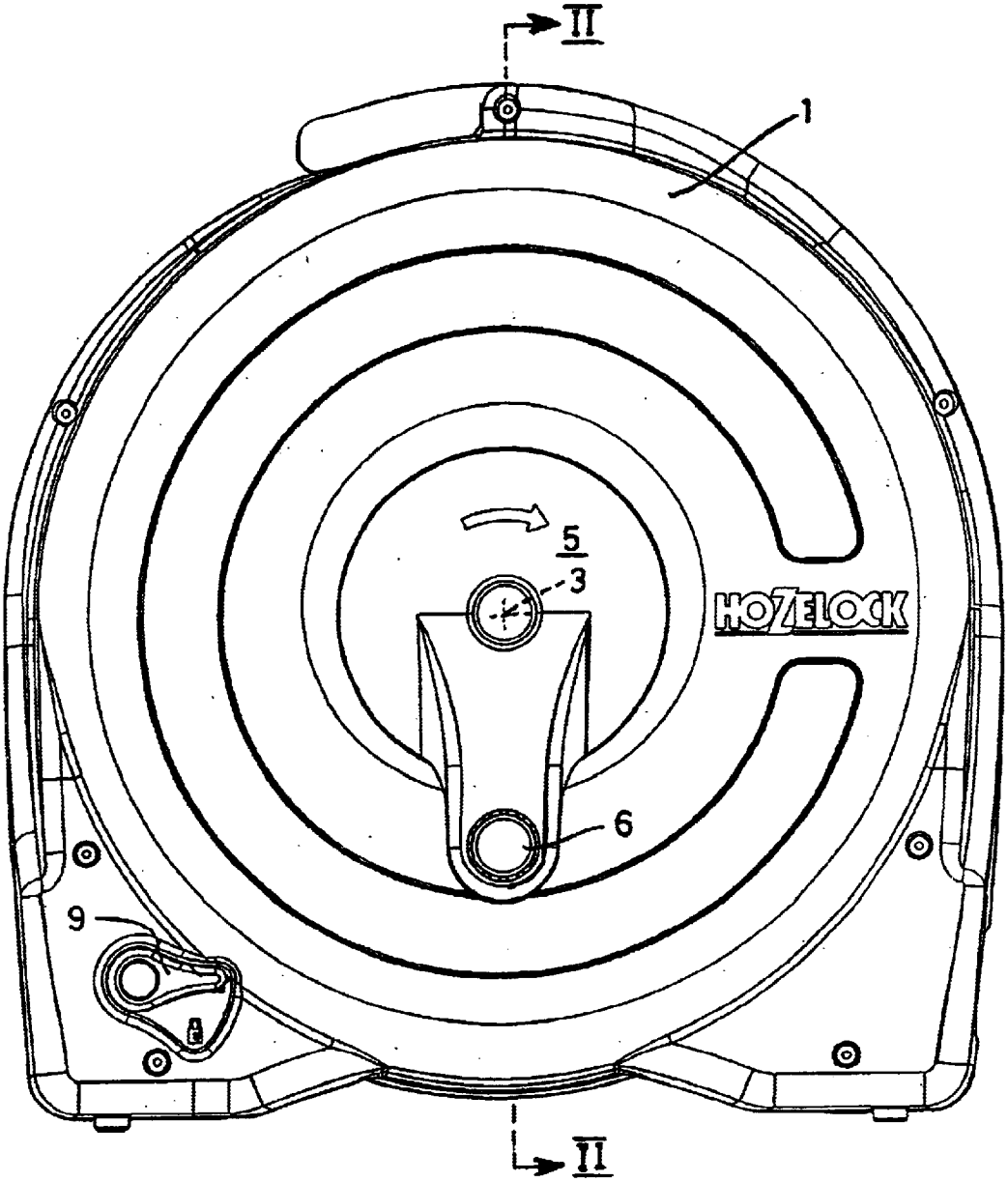
FIG. 1 is a front elevation of the hose reel assembly.

The hose reel comprises an outer casing 1 within which a shaft 2 is rotatably mounted about a central horizontal axis 3. The casing 1 surrounds a drum 4 which is capable of rotation, around the shaft 2, and hence about the axis 3. Attached to the front end of the shaft 2 is a drive assembly comprising a cover 5 from which projects an eccentric handle 6. The drive assembly also includes a ratchet 7 the teeth of which are engaged by a pawl 8 carried by the casing 1. The casing 1 also carries a pivotally mounted lever 9 attached to a crank 10 engageable with the teeth of a ring gear 12 on the outer periphery of the drum 4, to lock the drum 4 against rotation either during transit or to enable the user to lock the drum 4 in use so that no more hose pipe can be pulled out from the reel.

Figure 2:
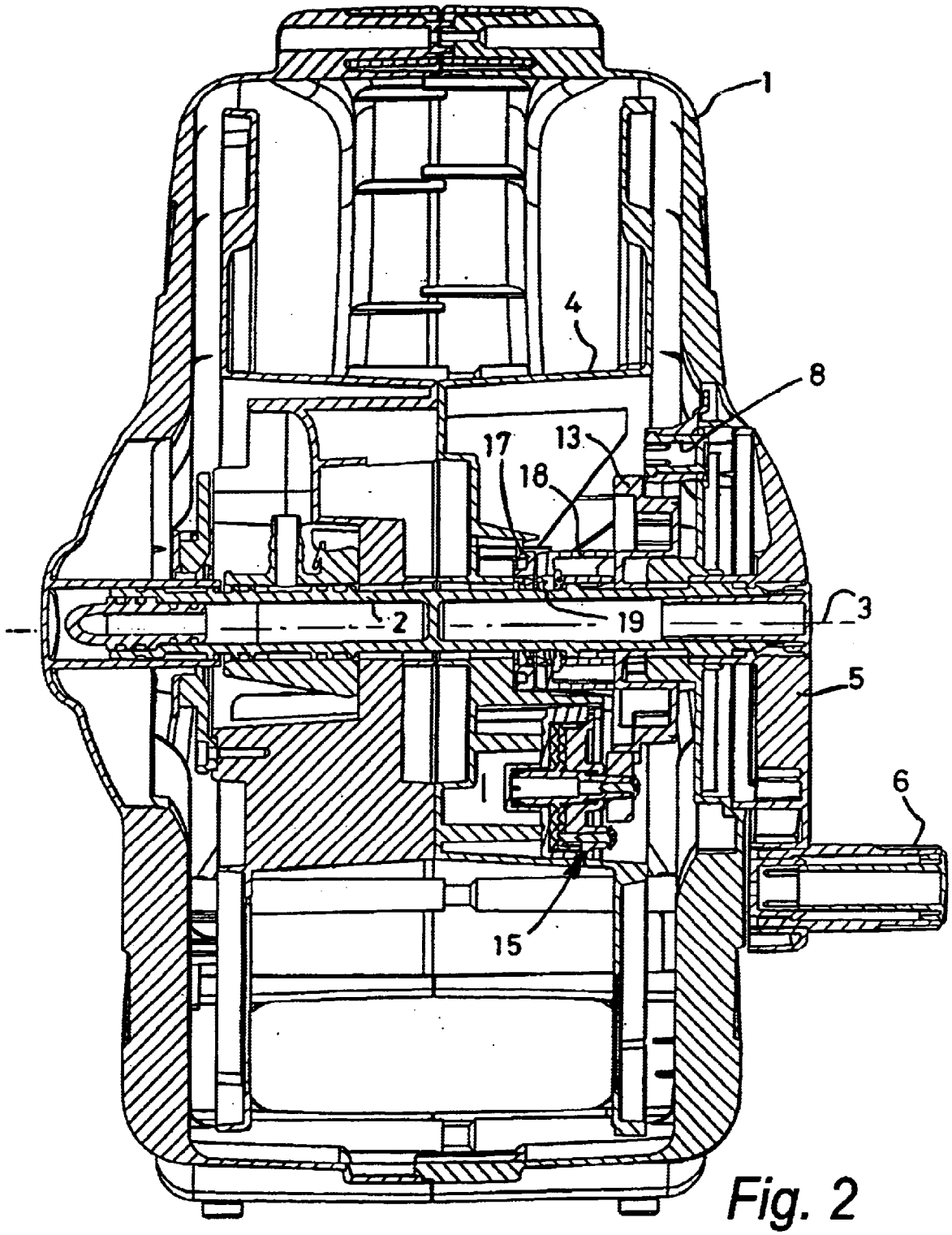
FIG. 2 is a sectional view on the line II—II of FIG. 1.

The drive assembly includes a drive gear 13 which meshes with a smaller pinion 14 mounted on the end of a rotor of a dashpot 15, the outer casing 16 of which is attached to the drum 4. Also attached to the drum 4 is a driven dog 17 capable of meshing with a drive dog 18 attached to the drive assembly. The two dogs 17 and 18 are biased apart, i.e. towards a disengaged position, by means of a spring 19 (FIG. 2) between them.

Starting with the hose pipe fully wound on the drum 4, the hose pipe is pulled out from the reel by grasping the free end of the hose pipe and pulling the hose pipe away from the reel. This causes the drum 4 to rotate anti-clockwise, as viewed in FIGS. 1 and 3. The drive gear 13 is prevented from rotation by the engagement of the pawl 8 in the ratchet 7. The dogs 17 and 18 are held apart by the spring 19, preventing the teeth on the dogs from entering engagement. The drum 4, driven dog 17 and dashpot 15 all rotate around the axis 3, this causing relative rotation between the dashpot rotor and the dashpot casing so that the dashpot 15 applies a force tending to restrain unwinding movement of the drum 4. In the well-known manner of a dashpot, the restraining force applied to the drum 4 is proportional to the angular velocity of unwinding rotation of the drum 4, so that the restraining force applied to the drum 4 increases as the rotational velocity of unwinding motion increases. This prevents overrun and ensures that the hose pipe in the reel remains neatly wound around the drum 4 and does not become loose. This in turn prevents the risk of the hose becoming tangled inside the reel, with the consequent risk of jamming.

Figure 3:
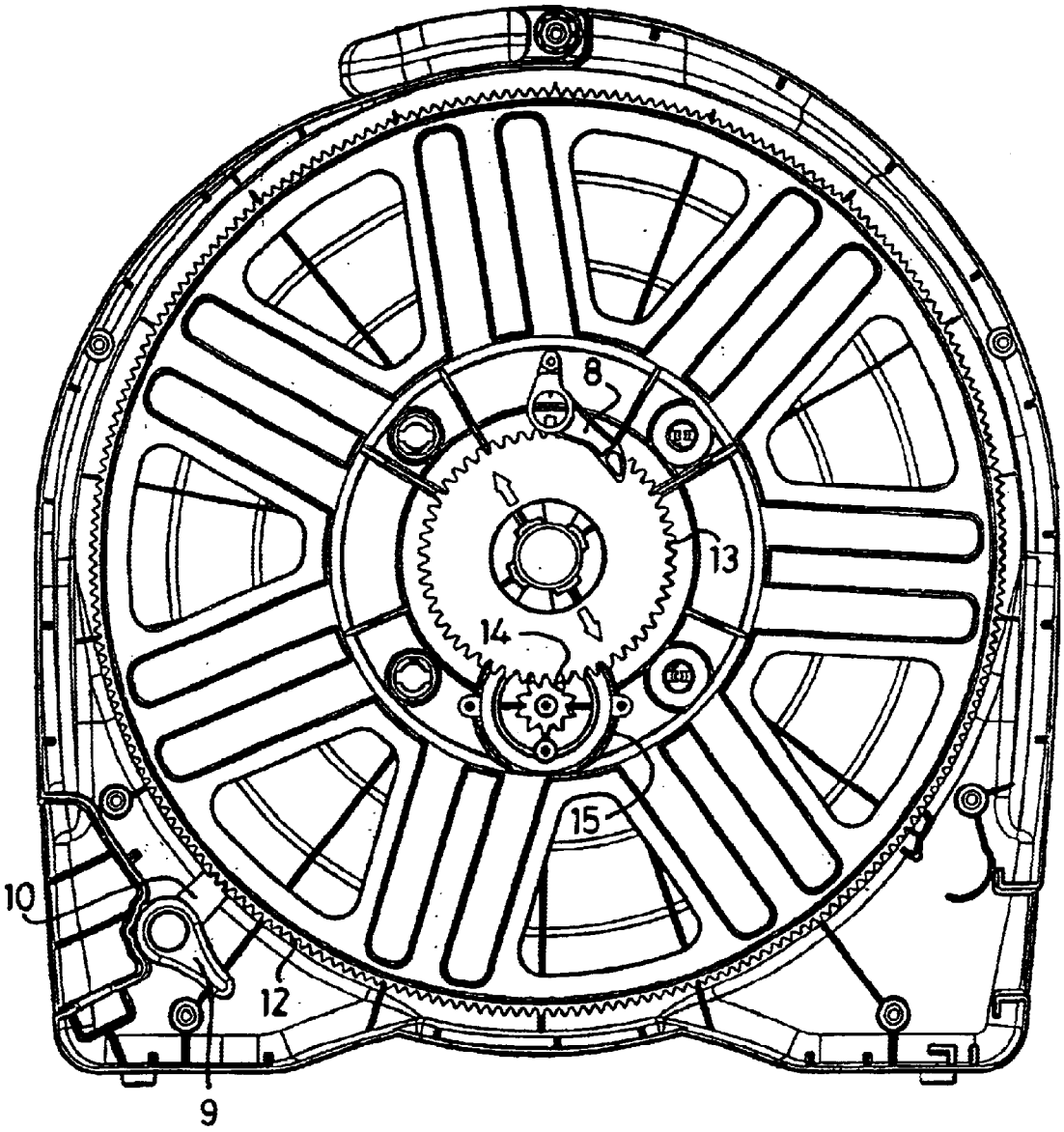
FIG. 3 is a front elevation with a handle and part of a front casing removed to show internal detail.
Figure 4:
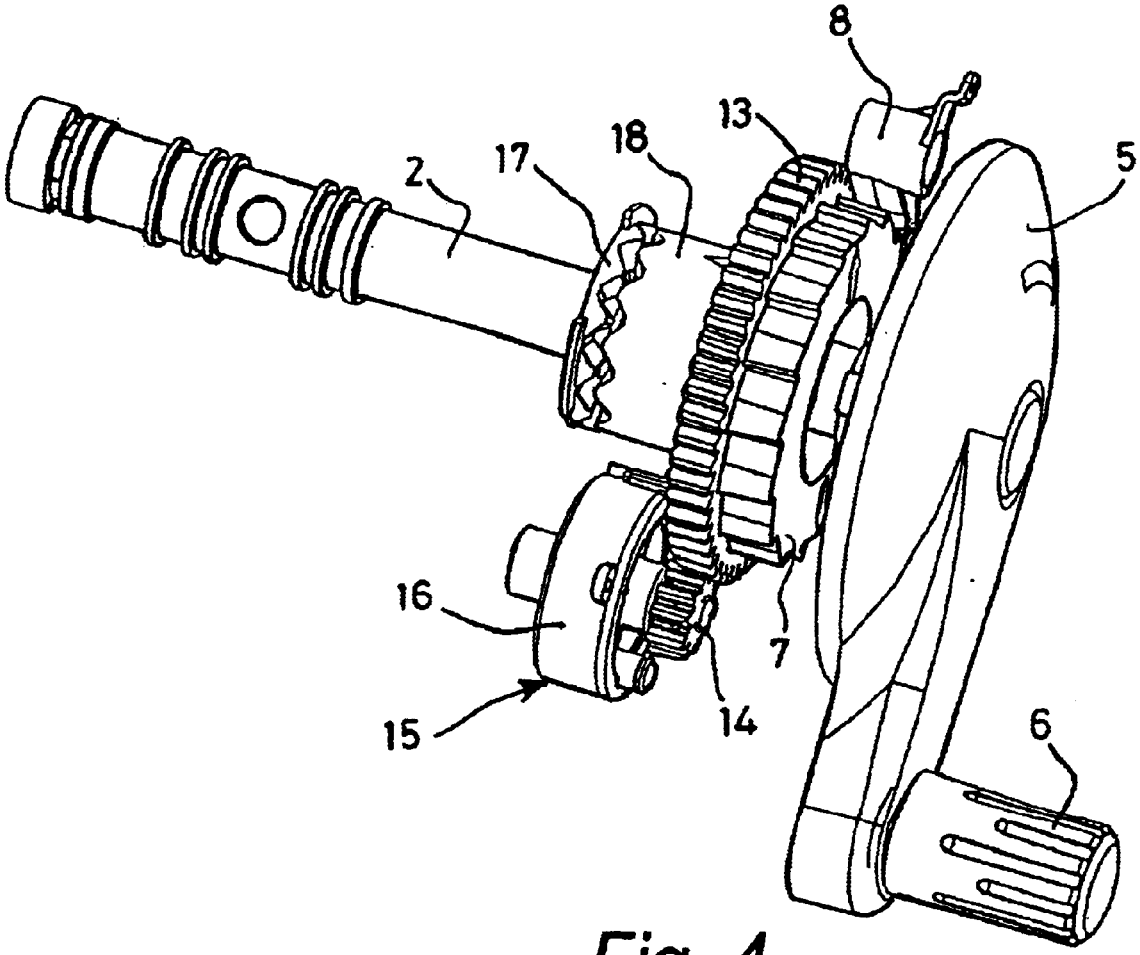
FIGS. 4 and 5 are two isometric views of a drive gear assembly of the hose reel.
Figure 5:
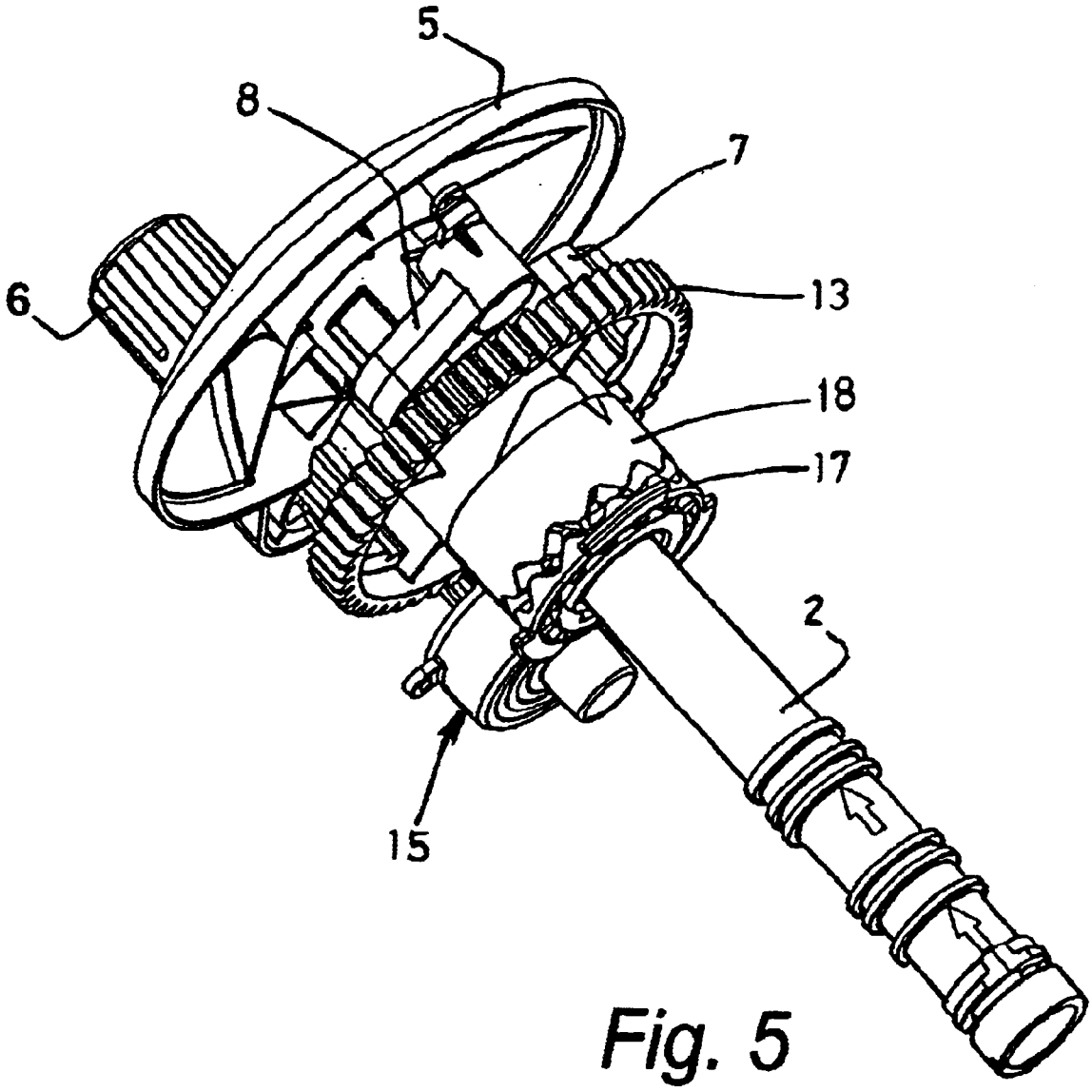

To wind the hose pipe onto the reel, the handle 6 is rotated clockwise as viewed in FIGS. 1 and 3. This rotates the shaft 2 which in turn rotates the drive dog 18 through the intermediary of four dogs formed on the shaft 2. The drive gear 13 is not coupled to the shaft and is prevented from rotating with the shaft by the resistance offered by the dashpot 15. As the drive dog 18 rotates, it rides up two ramps on the drive gear, thereby causing the teeth on the drive dog 18 and the driven dog 17 to engage. This inter-engagement of the two dogs 17 and 18 causes the drum 4 to rotate clockwise, causing the hose pipe to be wound onto the drum 4. During this clockwise rotation of the drive assembly, the drive gear 13 and the dashpot 15 rotate with the drum 4 as one unit so there is no relative rotation between the rotor and the casing of the dashpot 15. As a consequence, the dashpot 15 provides no damping action so that the user feels no resistance to rotation of the drum 4 in the clockwise direction corresponding to the hose pipe being wound onto the drum 4.

What is claimed is:

1. A hose reel having a drum rotatable in a first direction to cause a hose pipe to be wound around the drum and in a second direction to cause or allow the hose pipe to be unwound from the drum, wherein the drum has a damper operative to damp rotational movement of the drum in the second direction in order to prevent momentum resulting from the rotation of the drum in the second direction from causing overrun.

2. A hose reel according to claim 1, in which the hose reel is manually operable without spring assistance, the hose reel being equipped with a handle the rotation of which in the first direction causes a hose pipe to be wound onto the drum, the hose pipe being pulled out from the hose reel to cause attendant rotation of the drum in the second direction thereby to unwind the hose pipe from the drum.

3. A hose reel according to claim 2, in which the damper takes the form of a rotary dashpot having an outer casing mounted on the drum and an inner rotor which is rotatable with respect to the casing when the drum is rotated in the second direction.

4. A hose reel according to claim 1, in which the damper applies no damping action to the drum when the latter is rotated in the first direction.

5. A hose reel according to claim 3, in which the handle forms part of a drive assembly carrying a gear wheel the teeth of which mesh with a pinion which drives the inner rotor of the damper.

6. A hose reel according to claim 5, in which the drive assembly also includes a drive dog which is capable of engagement with a driven dog rotatable with the drum, the drive dog and driven dog being urged apart by a spring when the drum is rotated in the second direction but being urged into engagement, against the bias of the spring, when a handle of the hose reel is rotated to turn the drum in the first direction.

7. A hose reel according to claim 1, in which the reel includes a hose pipe wound around its drum.

8. A hose reel according to claim 1, in which the damper takes the form of a rotary dashpot having an outer casting mounted on the drum and an inner rotor which is rotatable with respect to the casing when the drum is rotated in the second direction.

* * * * *